US012031259B2

(12) United States Patent
Yoshikawa

(10) Patent No.: US 12,031,259 B2
(45) Date of Patent: Jul. 9, 2024

(54) WASHING MACHINE INCLUDING A DRUM FOR EASY UNLOADING

(71) Applicant: YUGEN KAISHA HIKARI DRY, Nara (JP)

(72) Inventor: Mutsuhito Yoshikawa, Nara (JP)

(73) Assignee: YUGEN KAISHA HIKARI DRY, Nara (JP)

( * ) Notice: Subject to any disclaimer, the term of this patent is extended or adjusted under 35 U.S.C. 154(b) by 166 days.

(21) Appl. No.: 17/431,769

(22) PCT Filed: Feb. 25, 2020

(86) PCT No.: PCT/JP2020/007503
§ 371 (c)(1),
(2) Date: Aug. 18, 2021

(87) PCT Pub. No.: WO2020/175480
PCT Pub. Date: Sep. 3, 2020

(65) Prior Publication Data

US 2022/0112644 A1 Apr. 14, 2022

(30) Foreign Application Priority Data

Feb. 26, 2019 (JP) ..... 2019-032387

(51) Int. Cl.
*D06F 37/08* (2006.01)
*D06F 37/06* (2006.01)

(52) U.S. Cl.
CPC ..... *D06F 37/08* (2013.01); *D06F 37/06* (2013.01)

(58) Field of Classification Search
CPC ..... D06F 37/06; D06F 37/08
See application file for complete search history.

(56) References Cited

U.S. PATENT DOCUMENTS 64,276 A * 4/1867 Bradley ..... D06F 37/08 68/143
101,778 A * 4/1870 Smith ..... D06F 37/08 68/143

(Continued)

FOREIGN PATENT DOCUMENTS

CN 101517141 A 8/2009
DE 448842 C 8/1927

(Continued)

*Primary Examiner* — Joseph L. Perrin
*Assistant Examiner* — Irina Graf
(74) *Attorney, Agent, or Firm* — SZDC Law PC

(57) ABSTRACT

A washing machine includes a drum for receiving laundry which washing machine not only prevents the laundry from becoming entangled in a complicated manner when the drum is rotated, but also beat-washes the laundry sufficiently. The washing machine includes a partition plate that is fixed to the inner circumferential surface of the drum and that divides the internal space of the drum into two washing compartments. The drum receives two washes in the respective washing compartments, and is rotated while reversing its rotation direction repeatedly. The partition plate and drum are rotated counterclockwise to an angle within a predetermined range and clockwise to an angle within a predetermined range. This allows the washing machine to repeat an operation of causing one of the two washes to slip down from a high position to be beat-washed and the other wash to be immersed in cleaning fluid for stain decomposition.

4 Claims, 12 Drawing Sheets

(56) References Cited

U.S. PATENT DOCUMENTS

| | | | | | |
|---|---|---|---|---|---|
| 197,229 | A | * | 11/1877 | Scolville | D06F 37/08 68/143 |
| 350,500 | A | * | 10/1886 | Price | D06F 37/08 68/145 |
| 859,564 | A | * | 7/1907 | Lawrence | D06F 37/08 68/143 |
| 1,701,224 | A | * | 2/1929 | Brannen | D06F 37/08 68/210 |
| 2,281,031 | A | | 4/1942 | Francey | |
| 6,397,422 | B1 | | 6/2002 | Maziere | |

FOREIGN PATENT DOCUMENTS

| | | | | | |
|---|---|---|---|---|---|
| EP | 1103646 | A1 | | 5/2001 | |
| EP | 2042638 | B1 | | 2/2018 | |
| GB | 868347 | A | | 5/1961 | |
| JP | H05184767 | A | | 7/1993 | |
| JP | 2000157779 | A | * | 6/2000 | |
| JP | 2001-212400 | A | | 8/2001 | |
| JP | 2015036081 | A | | 2/2015 | |
| JP | 2017099723 | A | | 6/2017 | |
| WO | WO-2009027306 | A1 | * | 3/2009 | D06F 37/08 |

* cited by examiner

WASHING MACHINE INCLUDING A DRUM FOR EASY UNLOADING

This application is the National Stage Application of PCT/JP2020/007503, filed on Feb. 25, 2020, which claims priority to Japanese Patent Application No. JP 2019-032387, filed on Feb. 26, 2019, which is incorporated by reference for all purposes as if fully set forth herein.

TECHNICAL FIELD

The present invention relates to washing machines, and in particular, relates to a washing machine including a drum from which a dried wash (laundry) can be taken out easily.

BACKGROUND ART

Recent years have seen a widespread service called "linen supply", which is a service of providing customers with linen products such as bed sheets, towels, and nightgowns. A linen supplier lends linen products that they have bought to customers such as hotels and hospitals, collects the linen products that the customers have used, washes the linen products, and then lends the linen products again to customers.

Linen products are known to be washed in, for example, a washing machine including a drum. Such a washing machine is configured to receive linen products in the drum and wash the linen products while rotating the drum in a single direction. Suppose a case where a long linen product such as a bed sheet is washed in such a washing machine, spin-dried through high-speed rotation of the drum, and then taken out of the drum. The linen product is, in this case, dried while it is entangled. This is because washing a long linen product such as a bed sheet in particular causes the linen product to become entangled in a complicated manner as a result of rolling in a single direction inside the washing compartment of the drum. This unfortunately makes it difficult to take the dried linen product out of the drum.

Patent Literature 1 discloses a washing machine that, in order to prevent linen products from becoming entangled during a washing operation, includes a cylindrical drum having a rotary shaft and containing a disk-shaped partition plate integral with the rotary shaft so that the drum and the partition plate are rotated together. The drum of the washing machine has an internal space divided by the partition plate into two washing compartments each configured to receive laundry. The drum is rotated in a single direction to wash the laundry.

Patent Literature 2 discloses a continuous washing machine including a plurality of washing drums and rinsing drums connected to one another. Each washing drum is configured to receive laundry and swing-wash the laundry, that is, repeat the following operation three times: the drum is rotated in a positive direction from 0° to 300° and then in a negative direction from 300° to 0°. The drum is then rotated from 0° to 360° to scoop up the laundry with use of a scoop member to a high position to let the laundry fall down and be thus beat-washed.

CITATION LIST

Patent Literature

Patent Literature 1
Japanese Unexamined Patent Application Publication, Tokukai, No. 2015-36081

Patent Literature 2
Japanese Unexamined Patent Application Publication, Tokukaihei, No. H5-184767

SUMMARY OF INVENTION

Technical Problem

Washing laundry in the washing machine disclosed in Patent Literature 1 allows the laundry to be less entangled than in a case of washing laundry in a drum containing no partition plate for dividing the internal space. This in turn allows dried laundry to be taken out of the drum relatively easily. The washing machine, however, still leaves laundry entangled, and fails to fully solve the issue of a long time period being required to take laundry out of the drum. The washing machine disclosed in Patent Literature 2 performs swing-washing and then beat-washing. The washing machine thus performs only a small number of beat-washing operations, and unfortunately fails to remove stains sufficiently.

In view of the above circumstances, the present invention has an object of providing a washing machine including a drum for receiving laundry which washing machine not only prevents the laundry from becoming entangled in a complicated manner when the drum is rotated, but also beat-washes the laundry sufficiently.

Solution to Problem

A first aspect of the present invention includes:

an outer barrel having a cylindrical shape and oriented horizontally;

a drum present inside the outer barrel, having a cylindrical shape, and configured to receive laundry;

cleaning fluid present in the outer barrel and the drum;

a rotary shaft connected to a side surface of the drum and configured to rotate the drum; and a partition plate that is fixed to an inner circumferential surface of the drum in such a manner as to be in close contact with the inner circumferential surface and that divides an internal space of the drum into a first washing compartment and a second washing compartment, wherein the washing machine is configured to rotate the rotary shaft in such a manner as to rotate the partition plate alternately in a first direction and a second direction opposite to the first direction to beat-wash the laundry after the laundry becomes immersed in the cleaning fluid, and the partition plate is rotated in the first direction to an angle that allows a first wash as a portion of the laundry in the first washing compartment to be scooped up from the cleaning fluid with use of a first end of the partition plate and slip down along the partition plate and then in the second direction to an angle that allows the first wash to be scooped up from the cleaning fluid with use of a second end of the partition plate and slip down along the partition plate.

A second aspect of the present invention is based on the first aspect of the present invention and is further arranged such that the partition plate is rotated further in the second direction to an angle that allows a second wash as a portion of the laundry in the second washing compartment to be scooped up from the cleaning fluid with use of the second end of the partition plate and slip down along the partition plate and then in the first direction to an angle that allows the second wash to be scooped up from the cleaning fluid with use of the second end of the partition plate again and slip down along the partition plate.

A third aspect of the present invention is based on the first or second aspect of the present invention and is further arranged such that the partition plate is provided with a plurality of ribs parallel to a direction in which the laundry slips down.

Advantageous Effects of Invention

The first aspect increases the rotation angle of the partition plate to an angle that allows a wash scooped up by the partition plate to slip down over the surface of the partition plate. The wash does not roll when slipping down over the surface of the partition plate. This prevents the wash from becoming much entangled, and thereby allows a dried wash to be taken out of the drum easily. The wash taken out can be disentangled easily. This improves the work efficiency of the worker. Further, the partition plate is rotated until a wash slips down. This allows the wash to fall from a high position, increasing the cleaning effect of the beat-washing.

The second aspect allows two washes in respective two washing compartments of the drum to alternately slip down over the surface of the partition plate. This allows the two washes to be beat-washed alternately without becoming entangled with each other.

The third aspect reduces the area of contact between a wash and the partition plate. This allows a wash to easily slip over the surface of the partition plate and be beat-washed with an increased cleaning effect. Further, the third aspect prevents a wash from easily rolling over the surface of the partition plate, and thereby prevents a wash from becoming entangled easily.

DESCRIPTION OF EMBODIMENTS

The description below deals with an embodiment of the present invention with reference to the attached drawings.

1. Embodiment

<1.1 Configuration of Washing Machine>

Figure 1:
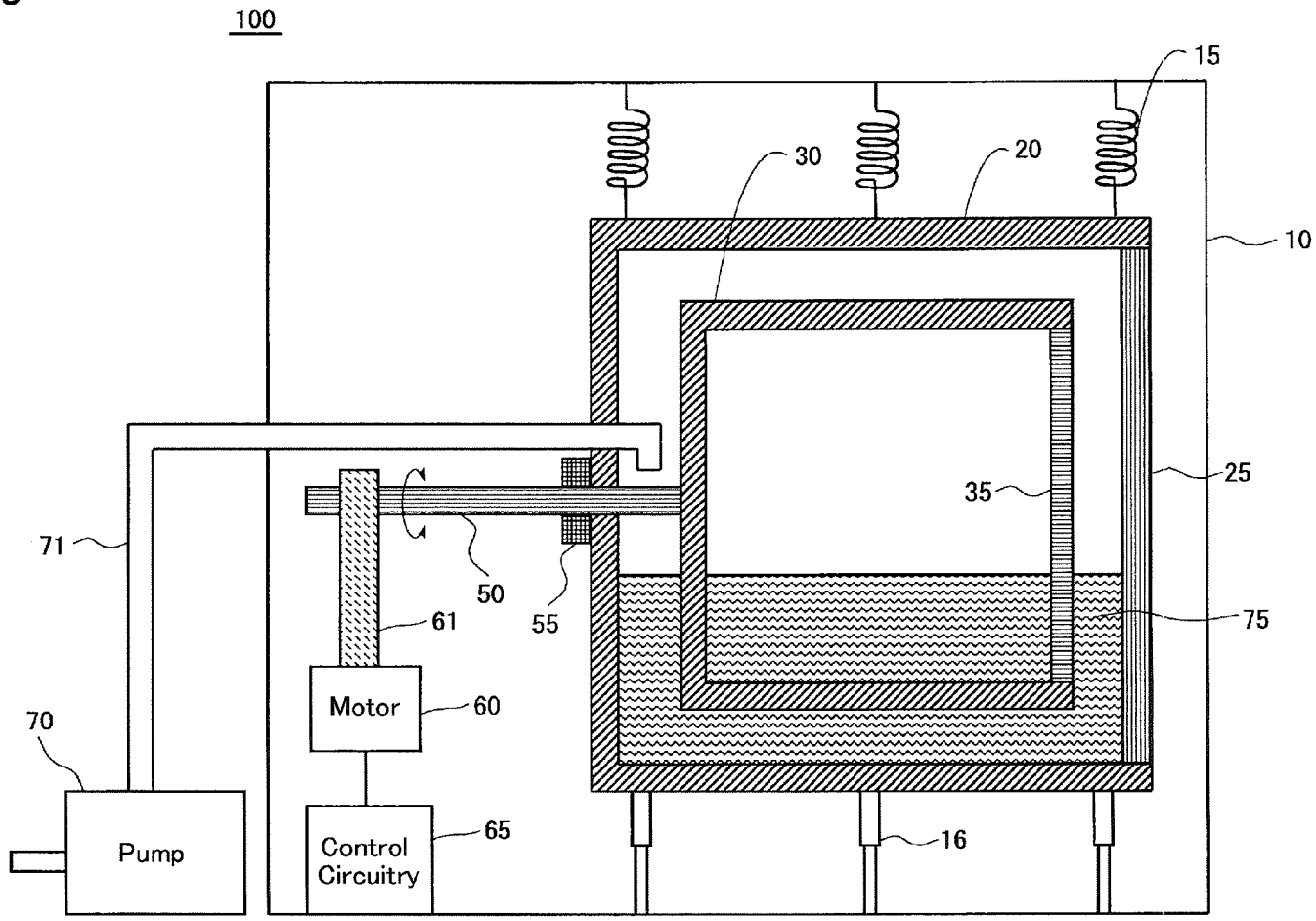
FIG. 1 is a vertical cross-sectional view of a washing machine as an embodiment of the present invention as taken along a front-back line extending through the center.
Figure 2A:
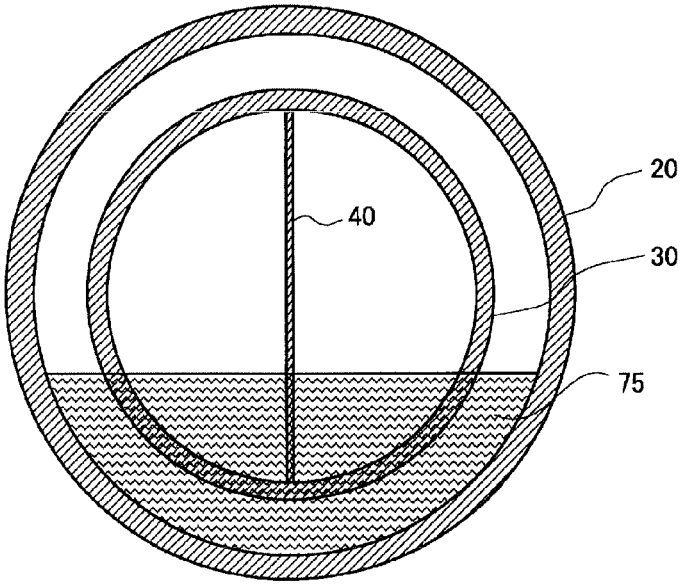
FIG. 2 provides front views of an outer barrel and a drum both included in the washing machine illustrated in FIG. 1. More specifically, FIG. 2(*a*) is a view of the outer barrel and the drum as containing cleaning fluid poured therein, and FIG. 2(*b*) is a view of the outer barrel and the drum with their respective lids and open.
Figure 2B:
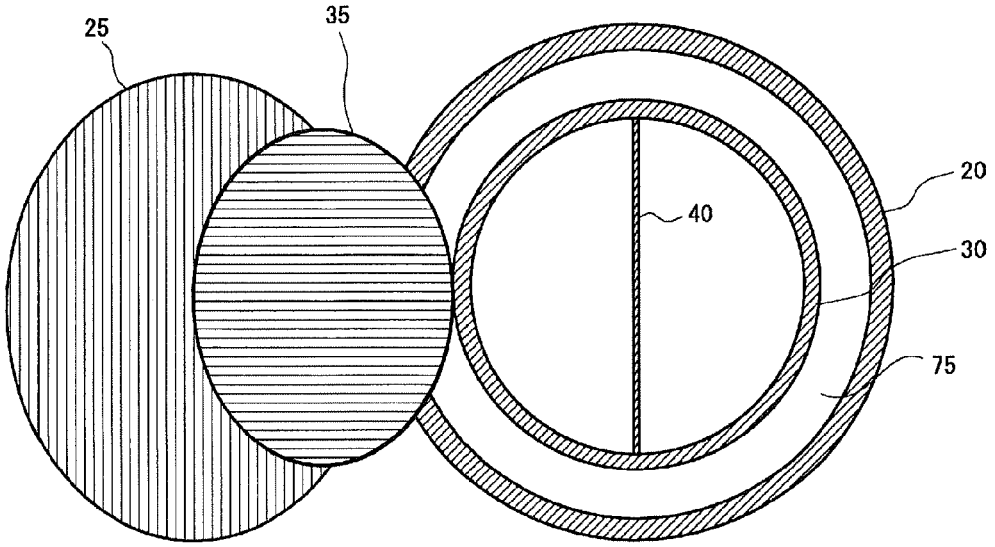

FIG. 1 is a vertical cross-sectional view of a washing machine 100 as an embodiment of the present invention, the view being taken along a front-back line extending through the center of the washing machine 100. FIG. 2 provides front views of an outer barrel 20 and a drum 30 both included in the washing machine 100 illustrated in FIG. 1. More specifically, FIG. 2(*a*) is a view of the outer barrel 20 and the drum 30 as containing cleaning fluid 75 poured therein, and FIG. 2(*b*) is a view of the outer barrel 20 and the drum 30 with their respective lids 25 and 35 open.

As illustrated in FIG. 1, the washing machine 100 includes a housing 10, an outer barrel 20 present inside the housing 10 and having a cylindrical shape, and a drum 30 (inner barrel) present inside the outer barrel 20 and having a cylindrical shape. The cylindrical outer barrel 20 and drum 30 are oriented substantially horizontally inside the housing 10. The washing machine 100 further includes suspension springs 15 attached to the upper surface of the outer barrel 20 and dampers 16 attached to the lower surface of the outer barrel 20. The outer barrel 20 is supported by the housing 10 by means of the suspension springs 15 and the dampers 16 in a vibration-isolating manner. The washing machine 100 further includes a rotary shaft 50 extending from a back surface side of the washing machine 100 to the center of the back surface of the drum 30. The rotary shaft 50 has a first end rotatably supported by a bearing 55 on the outer barrel 20 and a second end fixed to a central portion of the back surface of the drum 30. With this configuration, rotating the rotary shaft 50 also rotates the drum 30.

The drum 30 contains a rectangular partition plate 40 fitted therein and oriented along a line of the diameter of the drum 30 which line extends through the rotary shaft 50. The partition plate 40 is not illustrated in FIG. 1 as it coincides with the cross section of the drum 30. As illustrated in FIGS. 2(*a*) and 2(*b*), the partition plate 40 is oriented along a center line of the drum 30, and has two lengthwise sides fixed to the inner circumferential surface of the drum 30 in such a manner as to be in close contact with the inner circumferential surface of the drum 30. The partition plate 40 is thus rotated integrally with the drum 30, and has a rotation angle constantly equal to that of the drum 30. The partition plate 40 divides the internal space of the drum 30 into two equally sized washing compartments.

The washing machine 100 includes a motor 60 and a pump 70 outside the housing 10. The motor 60 is connected to the first end of the rotary shaft 50 via a belt 61 attached to the first end. Rotation of the motor 60 also rotates the rotary shaft 50. Controlling the direction of the rotation of the motor 60 allows the drum 30 and the partition plate 40 to be rotated clockwise or counterclockwise. Controlling the time period of the clockwise or counterclockwise rotation of the motor 60 controls the respective rotation angles of the drum 30 and the partition plate 40. The washing machine 100 includes control circuitry 65 connected to the motor 60 and configured to control the rotation direction and rotation time period of the motor 60.

The pump 70 is provided with (i) a pipe connected to a tank (not shown in the drawings) in which cleaning fluid 75 is stored and (ii) a pipe 71 configured to supply the cleaning fluid 75 into the outer barrel 20. Activating the pump 70 causes the cleaning fluid 75 to be supplied from the tank through the pump 70 and the pipe 71 into the outer barrel 20.

The side portion of the drum 30 and the partition plate 40 both have a larger number of small holes (not shown in the drawings). This allows cleaning fluid 75 supplied into the outer barrel 20 to (i) be supplied into the drum 30 as well through the small holes in the side portion of the drum 30 and (ii) flow from one washing compartment to the other through the small holes in the partition plate 40. This in turn allows cleaning fluid 75 supplied into the outer barrel 20 to have a constant level not only while the drum 30 is at rest but also while the drum 30 is rotating.

As illustrated in FIG. 1, the washing machine 100 includes a lid 25 attached to a front portion of the outer barrel 20 and a lid 35 attached to a front portion of the drum 30. The lids 25 and 35 are each openable to allow laundry to be brought into and taken out of the drum 30. To put laundry into the drum 30, the user first opens the lid 25 of the outer barrel 20 and then opens the lid 35 of the drum 30 while the drum 30 is at rest with the partition plate 40 vertical as illustrated in FIG. 2(*b*). Next, the user divides the laundry into two substantially equal amounts, and puts one into the left one of the washing compartments (separated by the partition plate 40) and the other into the right washing compartment. The user then sequentially closes the lid 35 of the drum 30 and the lid 25 of the outer barrel 20. To take the laundry out of the drum 30, the user opens and closes the lids 25 and 35 similarly.

The partition plate 40 preferably has a surface processed so that laundry impregnated with cleaning fluid 75 slips on it easily. The washing machine 100 is arranged to beat-wash laundry: when the drum 30 is rotated, the laundry slips down over the surface of the partition plate 40 to be slammed on the inner circumferential surface of the drum 30 or the liquid surface (detailed later). If the partition plate 40 has a slippery surface, the laundry will slip down at a higher speed. This allows laundry to be slammed strongly on the inner circumferential surface or the liquid surface for an increased cleaning effect.

Figure 3:
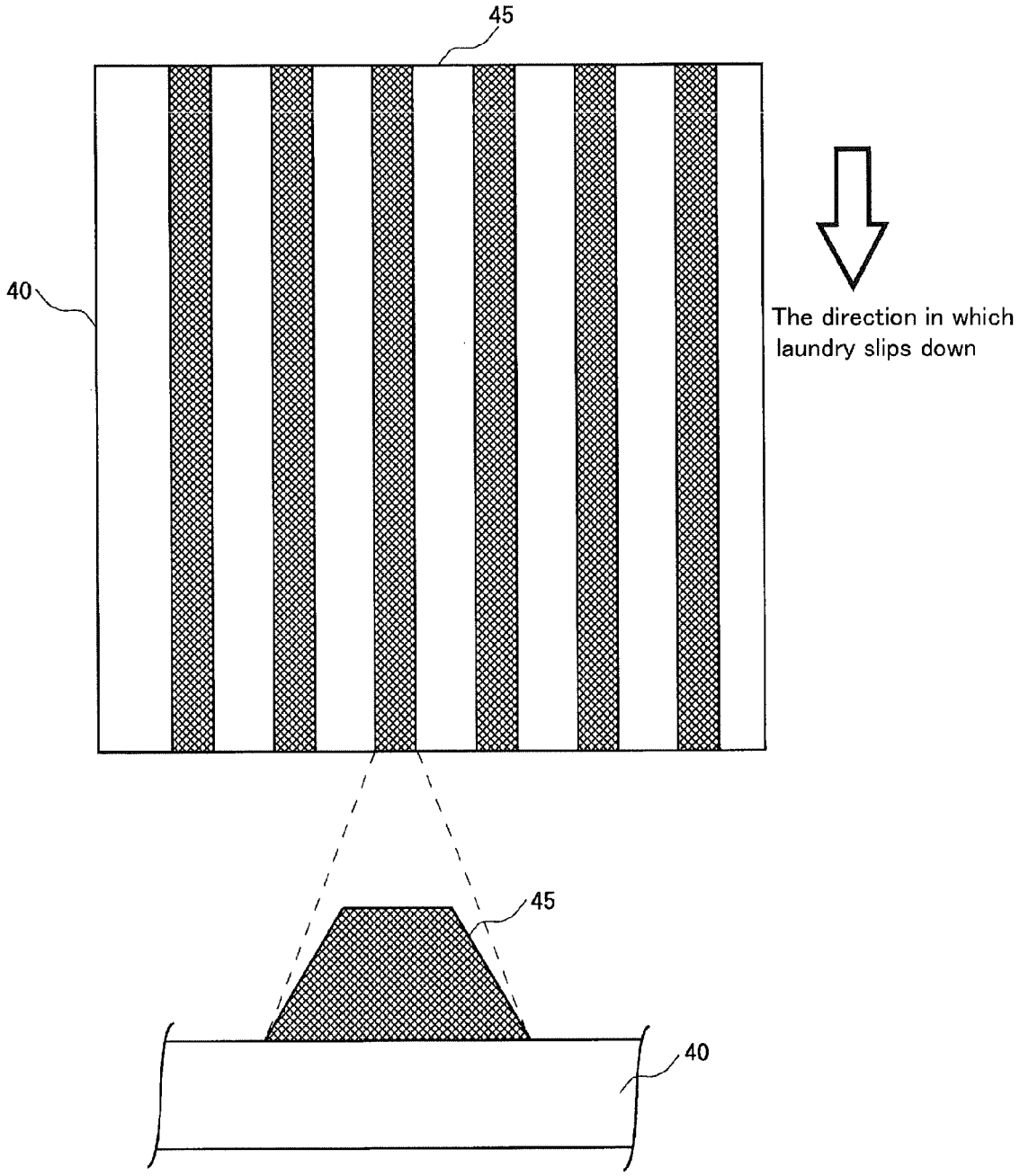
FIG. 3 provides a plan view and cross-sectional view of a partition plate provided with ribs.

FIG. 3 provides a plan view and cross-sectional view of a partition plate 40 provided with ribs 45. The partition plate 40 may be, as illustrated in FIG. 3, provided with a plurality of ribs 45 extending parallel to one another from a first end of the partition plate 40 to a second end thereof in a direction in which laundry slips down when the drum 30 has been rotated. The ribs 45 each have, for example, a convex, trapezoidal cross-sectional shape. This causes laundry to be in contact with the partition plate 40 over a smaller area, and thereby allows the laundry to easily slip down over the surface of the partition plate 40. This in turn allows laundry to slip down at a higher speed to be slammed strongly on the drum 30 or the liquid surface for an increased cleaning effect. Further, the above arrangement allows laundry to slip on the partition plate 40 along the ribs 45, and prevents laundry from easily rolling down and from easily becoming entangled when slipping down. The ribs 45 also strengthen the partition plate 40. The ribs 45 may each have a substantially triangular cross-sectional shape. The ribs 45 are optional.

<1.2 Washing Method>

Figure 4A:
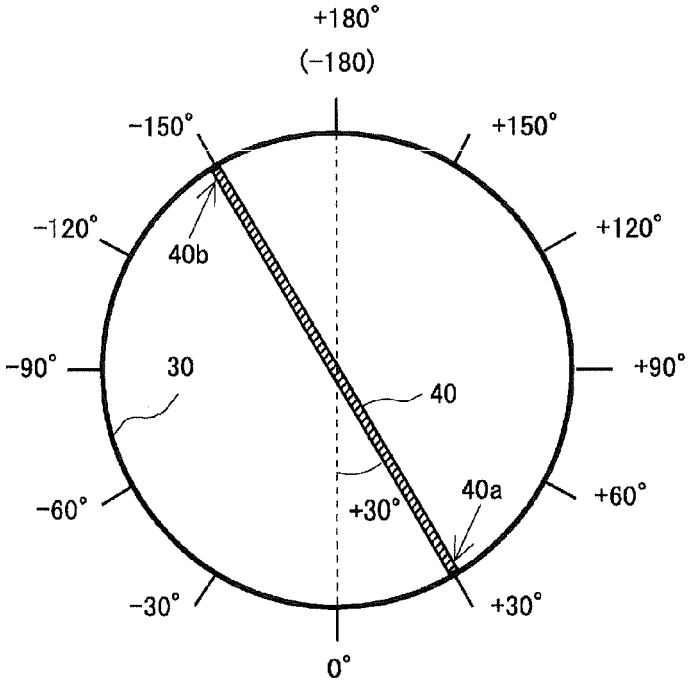
FIG. 4 provides diagrams each illustrating the rotation angle of a drum in terms of the position of a partition plate. More specifically, FIG. 4(*a*) is a diagram illustrating where the partition plate is positioned when the rotation angle is +30°, and FIG. 4(*b*) is a diagram illustrating where the partition plate is positioned when the rotation angle is −60°.
Figure 4B:
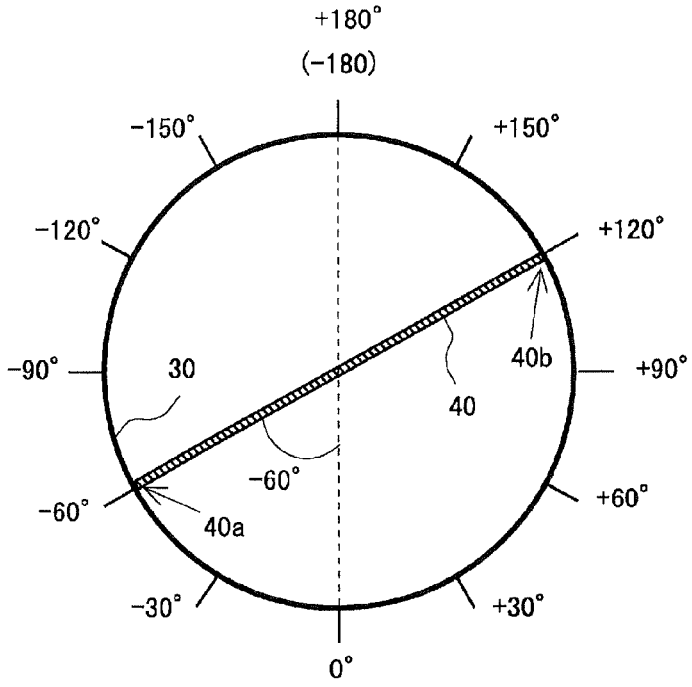

The washing machine 100 as the present embodiment is arranged such that rotating the drum 30 by an angle rotates the partition plate 40 (which is fixed to the drum 30) by the same angle. The present specification refers to the angle formed by the partition plate 40 and the vertical direction to express the rotation angle of the partition plate 40. FIG. 4 provides diagrams each illustrating the rotation angle of the drum 30 in terms of the position of the partition plate 40. More specifically, FIG. 4(*a*) is a diagram illustrating where the partition plate 40 is positioned when the rotation angle is +30°, and FIG. 4(*b*) is a diagram illustrating where the partition plate 40 is positioned when the rotation angle is −60°. As illustrated in FIG. 4(*a*), the present specification designates the position of the lowermost portion of the drum 30 as corresponding to a rotation angle of 0° and the position of the uppermost portion of the drum 30 as corresponding to a rotation angle of ±180°. The present specification also designates the counterclockwise direction from the lowermost portion as a positive rotation direction with each rotation angle indicated with a plus sign and the clockwise direction from the lowermost portion as a negative rotation direction with each rotation angle indicated with a minus sign. In view of that, FIG. 4(*a*) shows a number for each angle at every 30 degrees from the lowermost portion to the uppermost portion with a plus (+) sign for each angle to the right of the position corresponding to 0° and a minus (−) sign for each angle to the left of the position corresponding to 0°. FIG. 4(*a*) illustrates the partition plate 40 as being oriented to have an end 40*a* (which is a predetermine one of the opposite ends 40*a* and 40*b*) at a position corresponding to +30°. The partition plate 40, in this case, has a rotation angle of +30°. FIG. 4(*b*) illustrates the end 40*a* as being at a position corresponding to −60°. The partition plate 40, in this case, has a rotation angle of −60° similarly.

When the end 40*a* of the partition plate 40 is at the position corresponding to +30° as illustrated in FIG. 4(*a*), the partition plate 40 and the drum 30 are each regarded as having a rotation angle of +30°. When the end 40*a* is at the position corresponding to −60° as illustrated in FIG. 4(*b*), the partition plate 40 and the drum 30 are each regarded as having a rotation angle of −60°.

FIGS. 5 to 9 each provide diagrams illustrating a change in the relationship between the position of the end 40*a* of the partition plate 40 and the respective positions of a wash (laundry) 80*a* and a wash 80*b*. The user first divides laundry into two equal amounts (washes 80*a* and 80*b*), and opens the respective lids 25 and 35 of the outer barrel 20 and the drum 30. The user then puts the washes 80*a* and 80*b* respectively into the two washing compartments separated by the partition plate 40, and selects conditions such as a washing time period. Next, the user activates the pump 70 to pour cleaning fluid 75 into the outer barrel 20. The cleaning fluid 75 poured therein flows into the drum 30 as well through small holes. The washing machine 100 automatically stops cleaning fluid 75 from being poured when the cleaning fluid 75 in the outer barrel 20 and the drum 30 has reached a predetermined level.

Figure 5A:
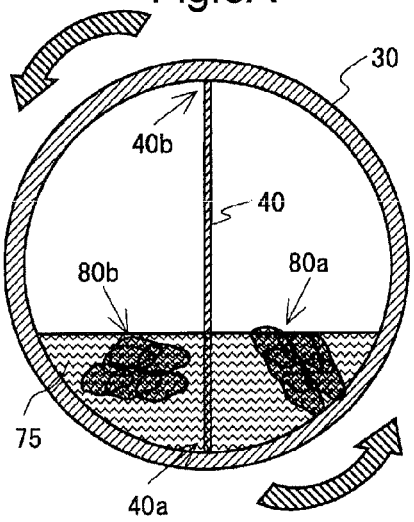
FIGS. 5(*a*) to 5(*c*) are diagrams illustrating a change in the relationship between the position of an end of a partition plate and the respective positions of washes which change is caused by rotation of the drum.
Figure 5B:
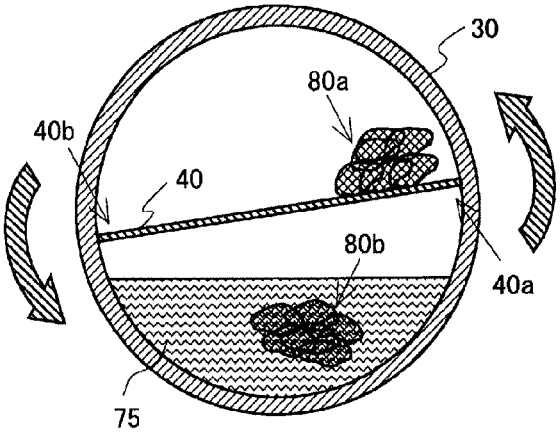
Figure 5C:
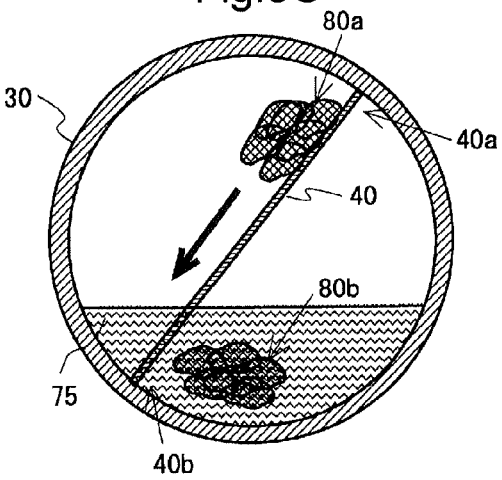

The washes 80*a* and 80*b* in the respective washing compartments are immersed in the cleaning fluid 75 as illustrated in FIG. 5(*a*), as the partition plate 40 is oriented at the angle of 0° whenever a washing operation ends and the drum 30 stops its rotation.

The washing machine 100 then rotates the partition plate 40 counterclockwise so that its rotation angle changes from 0° to +150° as illustrated in FIG. 5(*b*). As mentioned above with reference to FIGS. 4(*a*) and 4(*b*), the description below expresses a rotation angle in terms of the position of the end 40*a* of the partition plate 40. When the partition plate 40 starts counterclockwise rotation, the end 40*a* of the partition plate 40 starts to move upward, whereas the other end 40*b* starts to move downward. This causes the wash 80*a* to be scooped up from the cleaning fluid 75 by the end 40*a* of the partition plate 40. As the rotation angle becomes close to 150° as illustrated in FIG. 5(*c*), the wash 80*a* slips down over the surface of the partition plate 40 from the end 40*a* toward the end 40*b*, and is slammed on the inner circumferential surface of the drum 30 or the liquid surface of the cleaning fluid 75. This allows the wash 80*a* to be beat-washed.

Figure 6A:
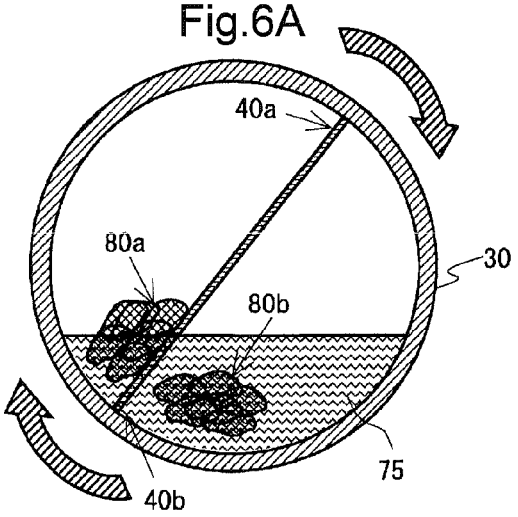
FIGS. 6(*a*) to 6(*c*) are diagrams illustrating a change in the relationship between the position of an end of a partition plate and the respective positions of washes which change is caused by rotation of the drum and follows the states illustrated in FIG. 5.
Figure 6B:
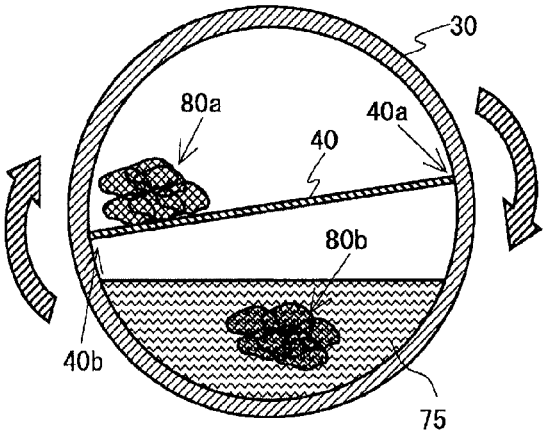
Figure 6C:
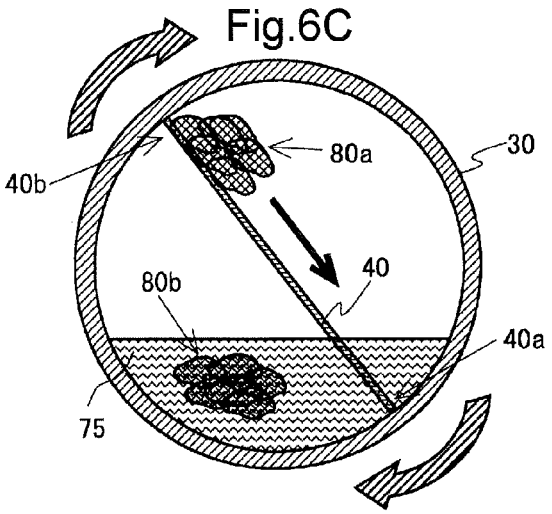

After the rotation angle of the partition plate 40 reaches +150°, the drum 30 reverses the direction of its rotation from counterclockwise to clockwise as illustrated in FIG. 6(*a*). When the drum 30 starts clockwise rotation, the end 40*b* starts to move upward, whereas the end 40*a* starts to move downward. This causes the wash 80*a* beat-washed as above to be scooped up again by the end 40*b* as illustrated in FIG. 6(*b*). As the rotation angle of the partition plate 40 becomes close to +30° as illustrated in FIG. 6(*c*), the wash 80*a* slips down over the surface of the partition plate 40 from the end 40*b* toward the end 40*a*, and is slammed on the inner circumferential surface of the drum 30 or the liquid surface of the cleaning fluid 75. This allows the wash 80*a* to be beat-washed again. While the wash 80*a* is repeatedly scooped up and beat-washed as described above, the wash 80*b* remains immersed in the cleaning fluid 75, so that stains thereon are decomposed through action of an enzyme(s) contained in the cleaning fluid 75.

Figure 7A:
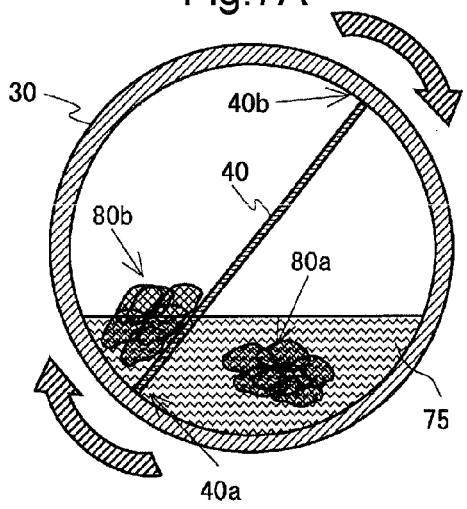
FIGS. 7(*a*) to 7(*c*) are diagrams illustrating a change in the relationship between the position of an end of a partition plate and the respective positions of washes which change is caused by rotation of the drum and follows the states illustrated in FIG. 6.
Figure 7B:
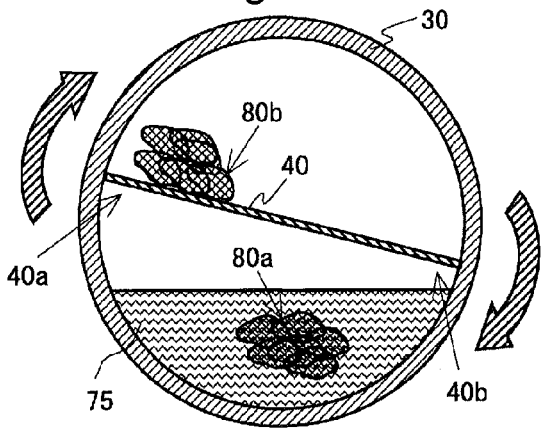
Figure 7C:
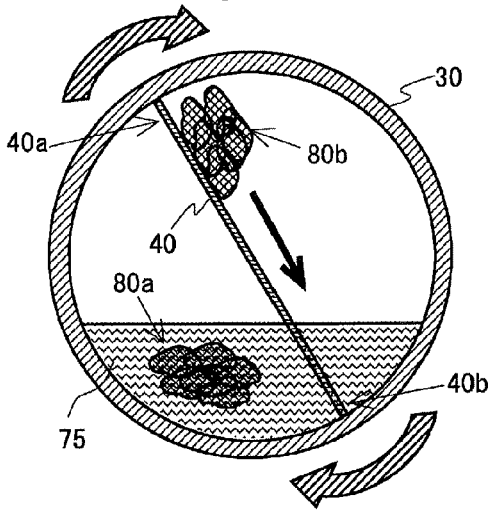

The partition plate 40 continues its clockwise rotation as illustrated in FIG. 7(*a*). The end 40*a* moves past the position corresponding to 0°, and starts to move upward whereas the end 40*b* starts to move downward. This causes the wash 80*b* to be scooped up by the end 40*a* as illustrated in FIG. 7(*b*). As the rotation angle of the partition plate 40 becomes close to −150° as illustrated in FIG. 7(*c*), the wash 80*b* slips down over the surface of the partition plate 40 from the end 40*a* toward the end 40*b*, and is slammed on the inner circumferential surface of the drum 30 or the liquid surface of the cleaning fluid 75. This allows the wash 80*b* to be beat-washed.

Figure 8A:
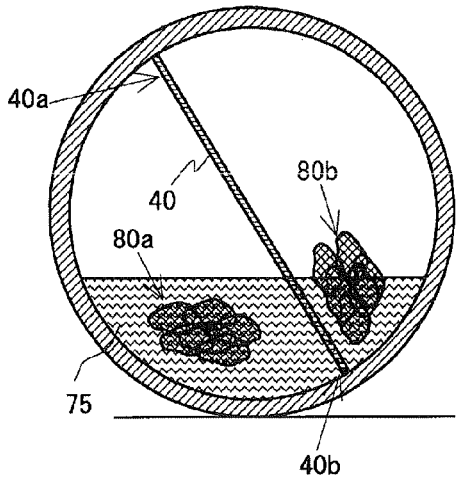
FIGS. 8(*a*) to 8(*c*) are diagrams illustrating a change in the relationship between the position of an end of a partition plate and the respective positions of washes which change is caused by rotation of the drum and follows the states illustrated in FIG. 7.
Figure 8B:
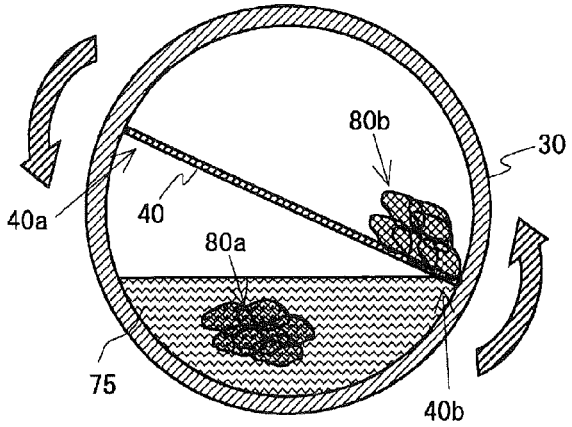
Figure 8C:
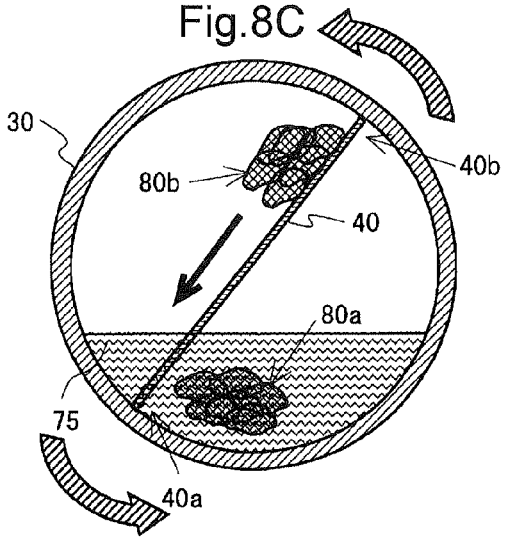

The partition plate 40 reverses the direction of its rotation from clockwise to counterclockwise as illustrated in FIG. 8(*a*). The end 40*a* starts to move downward, whereas the end 40*b* starts to move upward as illustrated in FIG. 8(*b*). This causes the wash 80*b* beat-washed as above to be scooped up again by the end 40*b*. As the rotation angle of the partition plate 40 becomes close to −30° as illustrated in FIG. 8(*c*), the wash 80*b* slips down over the surface of the partition plate 40 from the end 40*b* toward the end 40*a*, and is slammed on the inner circumferential surface of the drum 30 or the liquid surface of the cleaning fluid 75. This allows the wash 80*b* to be beat-washed again. While the wash 80*b* is repeatedly scooped up and beat-washed as described above, the wash 80*a* remains immersed in the cleaning fluid 75, so that stains thereon are decomposed through action of an enzyme(s) contained in the cleaning fluid 75.

Figure 9A:
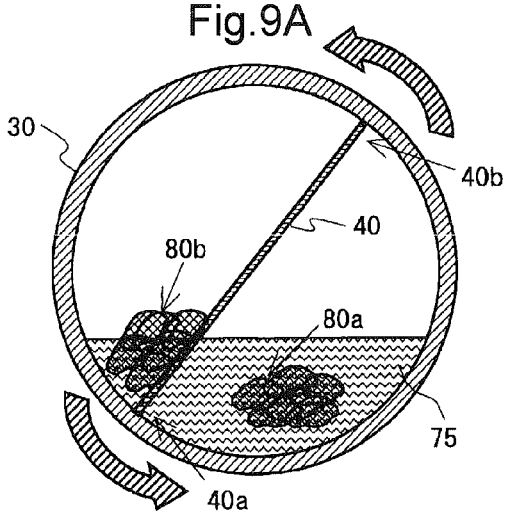
FIGS. 9(*a*) to 9(*c*) are diagrams illustrating a change in the relationship between the position of an end of a partition plate and the respective positions of washes which change is caused by rotation of the drum and follows the states illustrated in FIG. 8.
Figure 9B:
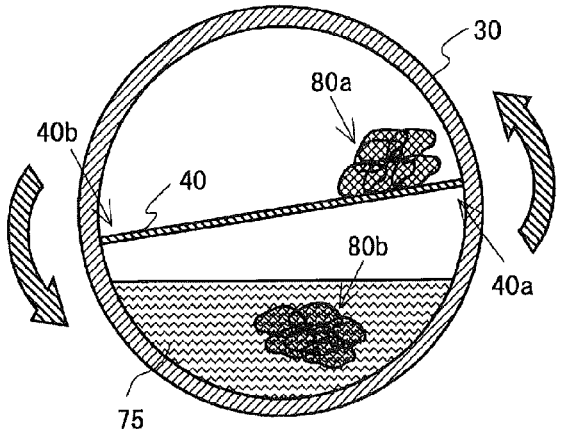
Figure 9C:
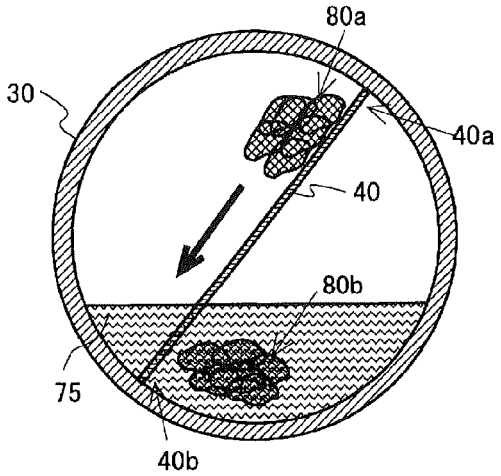

The partition plate 40 continues its counterclockwise rotation as illustrated in FIG. 9(*a*). When the rotation angle of the partition plate 40 starts to become larger than 0°, the end 40*a* starts to move upward, whereas the end 40*b* starts to move downward. This causes the wash 80*a* to be scooped up by the end 40*a* as illustrated in FIG. 9(*b*). As the rotation angle of the partition plate 40 becomes close to +150° as illustrated in FIG. 9(*c*), the wash 80*a* slips down over the surface of the partition plate 40 from the end 40*a* toward the end 40*b*, and is slammed on the inner circumferential surface of the drum 30 or the liquid surface of the cleaning fluid 75. This allows the wash 80*b* to be beat-washed. After that, the partition plate 40 will reverse the direction of its rotation from counterclockwise to clockwise. This state is identical to the above-described state illustrated in FIG. 5(*c*). The washing machine 100 will then repeat the operations illustrated in FIGS. 5(*c*) to 9(*c*). Overall, the partition plate 40 is rotated clockwise once and counterclockwise once to transition from the state illustrated in FIG. 5(*c*) to the state illustrated in FIG. 9(*c*) to allows each of the washes 80*a* and 80*b* to be beat-washed twice.

Figure 10:
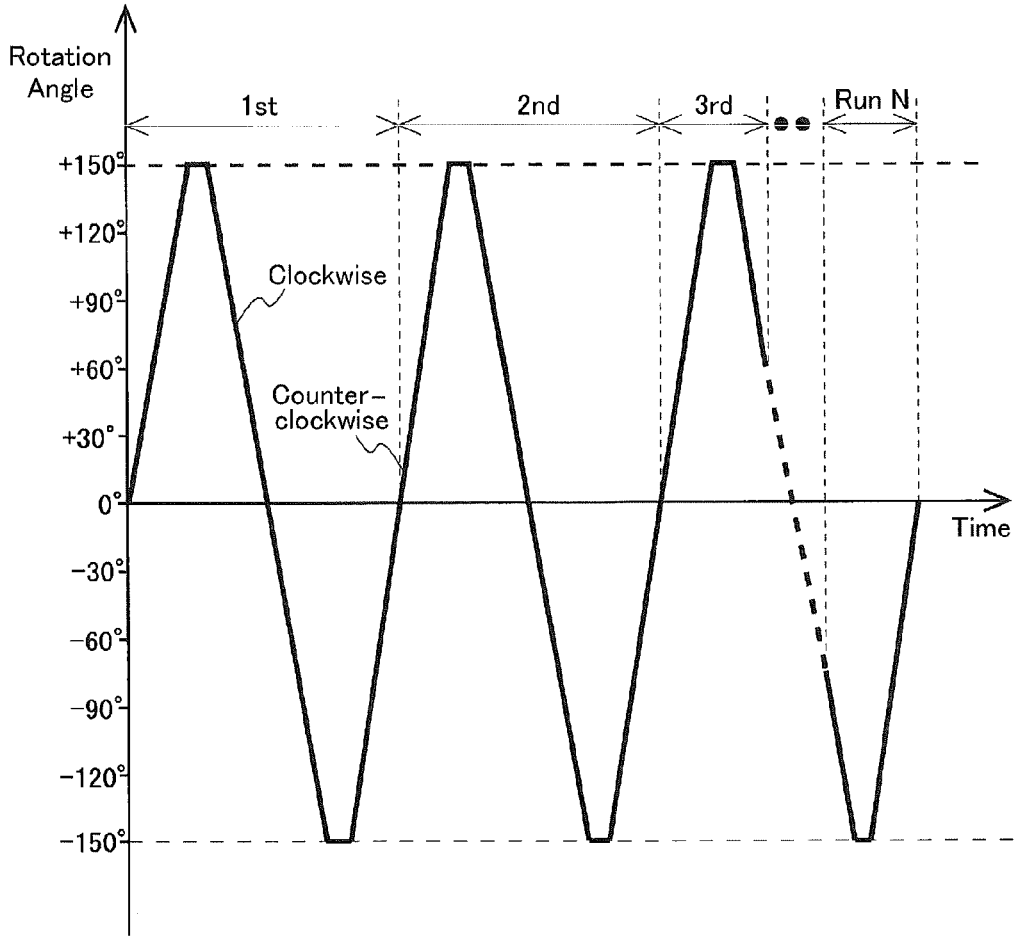
FIG. 10 is a graph that shows how the rotation angle of a partition plate changes over time.

FIG. 10 is a graph that shows how the rotation angle of the partition plate 40 changes over time. The partition plate 40 is rotated as shown in FIG. 10. Specifically, the partition plate 40, which is first at rest, starts rotation. The partition plate 40 is first rotated counterclockwise so that its rotation angle changes from 0° to +150°, and is then rotated clockwise so that its rotation angle returns to 0°. This allows a wash 80*a* to be beat-washed twice. Further, the partition plate 40 is rotated clockwise so that its rotation angle changes from 0° to −150°, and is then rotated counterclockwise so that its rotation angle returns to 0°. This allows a wash 80*b* to be beat-washed twice. The washing machine 100 subsequently repeats operations similar to the above, that is, alternately beat-washes the wash 80*a* twice and beat-washes the wash 80*b* twice, until a preset time point. The partition plate 40 (drum 30) ends its rotation with the rotation angle of 0°. The partition plate 40 stops its rotation for a time period of, for example, several seconds when the partition plate 40 reverses the direction of its rotation from clockwise to counterclockwise and counterclockwise to clockwise, that is, when the partition plate 40 is in each of the respective states illustrated in FIGS. 6(*a*), 7(*a*), and 8(*a*). This allows each wash having slipped down over the surface of the partition plate 40 to be sufficiently immersed in the cleaning fluid 75, and thereby allows stains thereon to be decomposed further through action of an enzyme(s) in the cleaning fluid 75.

The partition plate 40 is described above as being rotated counterclockwise first and then clockwise. The partition plate 40 may, however, alternatively be rotated clockwise first and then counterclockwise.

<1.3 Effects>

The washing machine 100 is arranged to rotate the drum 30 counterclockwise by 150°, return the drum 30 to 0°, and then rotate the drum 30 clockwise by 150°. This allows the following operation to be performed twice: scoop up a wash by the partition plate 40 and then let the wash slip down along the partition plate 40. Reversing the direction of the rotation of the drum 30 causes a wash to slip down along the partition plate 40. This can prevent the wash from becoming much entangled during a washing operation. This in turn allows a dried wash to be easily taken out of the drum 30. The wash taken out of the drum 30 is not much entangled, and can thus be disentangled easily, improving the work efficiency of the worker. Further, the washing machine 100 is arranged to rotate the drum 30 until a wash slips down along the partition plate 40. This allows the wash to slip down from a high position, increasing the cleaning effect of the beat-washing.

<1.4 Preferable Range of Rotation Angle>

The description above has dealt with an example case in which the drum 30 (partition plate 40) is rotated within the rotation angle range of +150° to −150°. As described above, once a wash has been scooped up by the partition plate 40, the wash slips down over the surface of the partition plate 40, and is slammed on the inner circumferential surface of the drum 30 or the liquid surface of the cleaning fluid 75. This allows the wash to be beat-washed. Such beat-washing requires causing the wash scooped up to slip over the surface of the partition plate 40. This in turn requires rotating the partition plate 40 past the horizontal direction to have a rotation angle of at least larger than 90° or smaller than −90°. Rotating the partition plate 40 to a rotation angle of larger than +180° or smaller than −180° will cause the wash to roll in the drum 30 as it slips down over the surface of the partition plate 40, with the result of an entangled wash. In view of that, the washing machine 100 as the present embodiment is preferably arranged to rotate the partition plate 40 counterclockwise to at least an angle within the range of larger than +90° and smaller than +180° and clockwise to at least an angle within the range of smaller than −90° and larger than −180° in order to cause a wash to slip down over the surface of the partition plate 40.

Rotating the partition plate 40 to a rotation angle of close to +90° or −90° within the above range causes a wash to slip down slowly over the surface of the partition plate 40 due to the gentle inclination. This may prevent the wash from being beat-washed sufficiently. Rotating the partition plate 40 to a rotation angle of close to +180° or −180° is not exactly efficient because the wash will have already slipped down over the surface of the partition plate 40 before the partition plate 40 reaches such a rotation angle. Such rotation may unfortunately waste the washing time period and electricity cost.

In view of the above, the washing machine 100 is preferably arranged to rotate the partition plate 40 counterclockwise to at least (i) an angle within the range of not smaller than +130° and not larger than +165° or (ii) an angle within the range of not smaller than −50° and not larger than −15° (if based on the position of the end 40*b* of the partition plate 40, an angle within the range of not smaller than +130° and not larger than) +165° and clockwise to at least (i) an angle within the range of not smaller than +15° and not larger than +50° (if based on the position of the end 40*b* of the partition plate 40, an angle within the range of not smaller than −165° and not larger than −130° or (ii) an angle within the range of not smaller than −165° and not larger than −130°. This allows a wash scooped up to slip down along the partition plate 40 efficiently.

The partition plate 40 is described above as being rotated counterclockwise first and then clockwise. The partition plate 40 may, however, alternatively be rotated clockwise first and then counterclockwise.

2. Other

Figure 11:
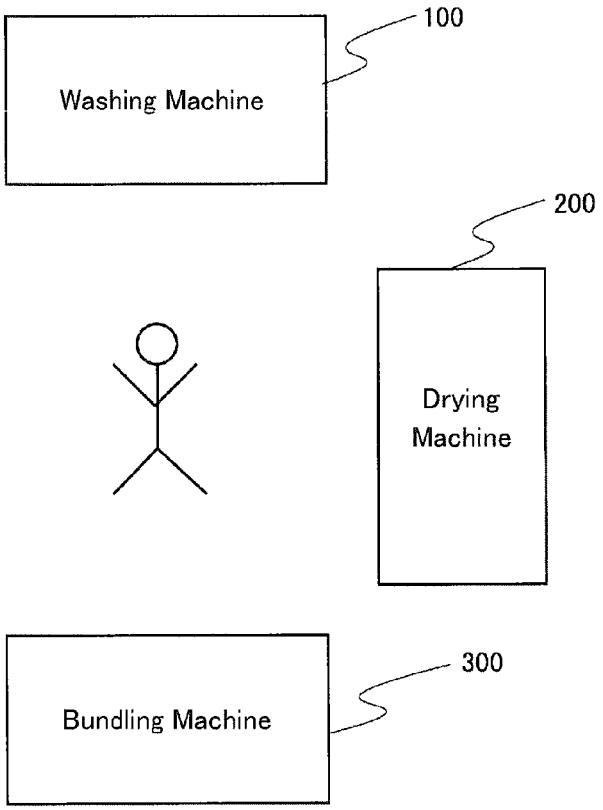
FIG. 11 is a diagram illustrating an arrangement of apparatuses necessary for a linen supplier, the apparatuses including a washing machine described below as an embodiment.

FIG. 11 is a diagram illustrating an arrangement of apparatuses necessary for a linen supplier, the apparatuses including the washing machine described as the present embodiment. As illustrated in FIG. 11, the arrangement includes a drying machine 200 and a bundling machine 300 in addition to the washing machine 100. Linen suppliers have used a continuous washing machine to wash a large amount of laundry in a short time period. A continuous washing machine, which is a large apparatus including two or more washing tubs, requires a large installation area. Linen suppliers have also used an oil hydraulic press to dry washed laundry in a short time period. Thus, washed laundry, which has been compressed through a drying operation in the washing machine, needs to be disentangled before being put into the drying machine. Linen suppliers have needed an apparatus for such disentanglement. Installing a continuous washing machine requires a large area for not only the continuous washing machine itself but also other apparatuses for use around the continuous washing machine as described above. Such installation thus requires a large facility.

The washing machine 100 as the present embodiment, in contrast, includes only one drum 30, and is arranged to rotate the drum 30 at a high speed to dry laundry. Further, the washing machine 100 is, as described above, arranged to wash laundry in such a manner that the laundry does not become entangled easily, and eliminates the need for an apparatus for disentangling dried laundry. These arrangements allow the washing machine 100 as the present embodiment to be small in size. In addition, the washing machine 100 requires only a small installation area even if installed together with a drying machine 200 such as a roller iron and a bundling machine 300 configured to fold laundry and bundle a predetermined number of sheets together. There is no need for a dedicated facility: the above apparatuses may be installed in a part of an existing building. The present embodiment thus allows apparatuses necessary for a series of steps ranging from washing to bundling and an area for installation of such apparatuses to be prepared more inexpensively than conventional.

The washing machine 100, the drying machine 200, and the bundling machine 300 may be arranged in a U-shape so that workers can be present at the center as illustrated in FIG. 11. This allows a series of tasks ranging from washing to bundling to be performed efficiently by fewer workers.

Figure 12:
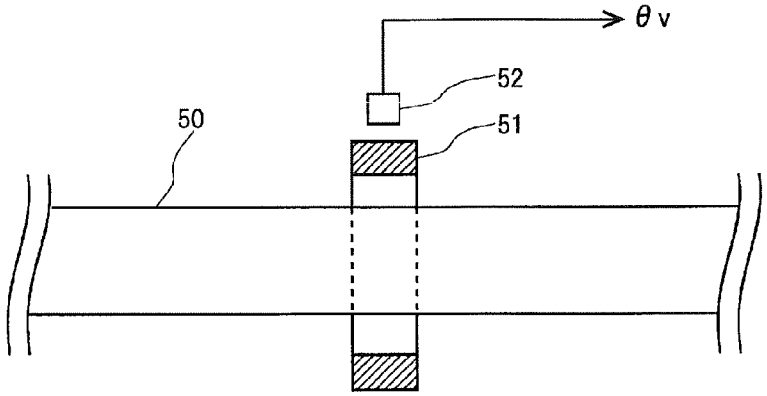
FIG. 12 is a diagram illustrating an arrangement of a ring magnet and a magnetism detecting element both for measuring the rotation angle of a rotary shaft.
Figure 13:
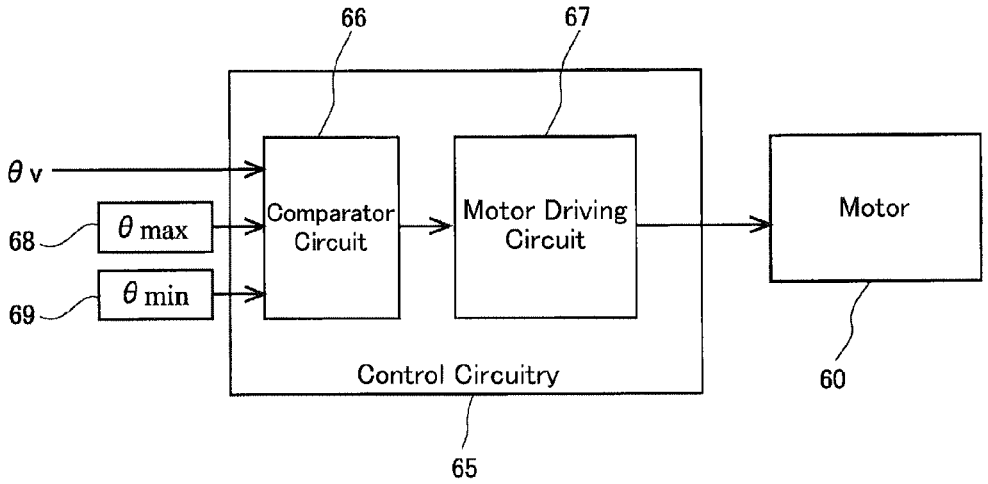
FIG. 13 is a diagram illustrating, for example, control circuitry configured to control a motor on the basis of a rotation angle measured.

The washing machine 100 illustrated in FIG. 1 includes a drum 30 provided with a partition plate 40 fixed thereto, the partition plate 40 having a rotation angle controlled through control of the time period of the clockwise or counterclockwise rotation of the motor 60 as described above. The rotation angle of the partition plate 40 may alternatively be measured and controlled with use of a different device and method as follows: FIG. 12 is a diagram illustrating an arrangement of a ring magnet 51 and a magnetism detecting element 52 both for measuring the rotation angle of the rotary shaft 50 of the drum 30. FIG. 13 is a diagram illustrating, for example, control circuitry 65 configured to control the motor 60 on the basis of the rotation angle measured by the magnetism detecting element 52. For instance, the ring magnet 51 is attached to the outer surface of the rotary shaft 50, whereas the magnetism detecting element 52, which includes a magnetic resistive element (magnetic resistive sensor), is positioned near the ring magnet 51 as illustrated in FIG. 12. When the rotation of the rotary shaft 50 also rotates the ring magnet 51, the magnetism detecting element 52 detects the intensity of the magnetic field by a well-known method, converts the intensity into a voltage value Ov, and outputs the voltage value θv to the control circuitry 65 illustrated in FIG. 13.

The control circuitry 65 includes a comparator circuit 66 and a motor driving circuit 67. The comparator circuit 66 is a well-known comparator, and compares the voltage value θv outputted from the magnetism detecting element 52 with a maximum voltage value θmax, which indicates the maximum value of the rotation angle, and with a minimum voltage value θmin, which indicates the minimum value of the rotation angle. If the voltage value θv reaches the maximum voltage value θmax or the minimum voltage value θmin, the comparator circuit 66 switches a binary signal and outputs the resulting signal to the motor driving circuit 67 to reverse the direction of the rotation of the motor. The motor driving circuit 67, in response, starts rotating the motor 60 in the opposite direction on the basis of the binary signal as switched. The maximum voltage value θmax (which corresponds to the maximum value of the rotation angle) is indicated with a voltage generated by a maximum value voltage generating circuit 68, which transmits a signal indicative of the voltage to the comparator circuit 66. The minimum voltage value θmin (which corresponds to the minimum value of the rotation angle) is indicated with a voltage generated by a minimum value voltage generating circuit 69, which transmits a signal indicative of the voltage to the comparator circuit 66. The maximum value voltage generating circuit 68 and the minimum value voltage generating circuit 69 may alternatively be configured to change the maximum voltage value θmax and the minimum voltage value θmin as necessary. An alternative, publicly known method may be used to measure the rotation angle. Further, alternative, publicly known device and method may be used to detect whether the measured rotation angle has reached the maximum value or the minimum value and reverse the rotation direction.

The present invention is, as described above, not limited to the above embodiment, and may be altered variously without departing from its scope.

REFERENCE SIGNS LIST

20 Outer barrel
30 Drum (inner barrel)
40 Partition plate
50 Rotary shaft
60 Motor
70 Pump
75 Cleaning fluid
80*a*, 80*b* Wash (laundry)
100 Washing machine

The invention claimed is:

1. A washing machine, comprising:

an outer barrel having a cylindrical shape, oriented substantially horizontally, and capable of containing a cleaning fluid;

a drum present inside the outer barrel, having a cylindrical shape, and configured to receive laundry and the cleaning fluid;

a rotary shaft connected to a side surface of the drum and configured to rotate the drum;

a partition plate that is fixed to an inner circumferential surface of the drum in such a manner as to be in close contact with the inner circumferential surface and that divides an internal space of the drum into a first washing compartment and a second washing compartment; and a control circuitry configured to control the rotation of the rotary shaft in such a manner as to rotate the partition plate alternately in a first direction and a second direction opposite to the first direction to beat-wash the laundry after the laundry becomes immersed in the cleaning fluid, wherein the control circuitry is adapted to control the rotation of the rotary shaft to rotate the partition plate in the first direction continuously to a first angle that allows a first wash as a portion of the laundry in the first washing compartment to be scooped up from the cleaning fluid with use of a first end of the partition plate and slip down along the partition plate and then in the second direction continuously to a second angle that allows the first wash to be scooped up from the cleaning fluid with use of a second end of the partition plate and slip down along the partition plate.

2. The washing machine according to claim 1, wherein the control circuitry is adapted to control the rotation of the rotary shaft to rotate the partition plate further in the second direction continuously to a third angle that allows a second wash as a portion of the laundry in the second washing compartment to be scooped up from the cleaning fluid with use of the first end of the partition plate and slip down along the partition plate and then in the first direction continuously to a fourth angle that allows the second wash to be scooped up from the cleaning fluid with use of the second end of the partition plate again and slip down along the partition plate.

3. The washing machine according to claim 2, wherein the partition plate is provided with a plurality of ribs parallel to a direction in which the laundry slips down when the partition plate is rotated in the first direction to the first angle or the fourth angle or in the second direction to the second angle or the third angle.

4. The washing machine according to claim 1, wherein the partition plate is provided with a plurality of ribs parallel to a direction in which the laundry slips down when the partition plate is rotated in the first direction to the first angle or in the second direction to the second angle.

* * * * *